United States Patent [19]

McCoag

[11] 3,937,507

[45] Feb. 10, 1976

[54] PADLOCK

[75] Inventor: John McCoag, Glasgow, Scotland

[73] Assignee: Aardee Spring & Lock Company Limited, Glasgow, Scotland

[22] Filed: July 22, 1974

[21] Appl. No.: 490,842

[30] Foreign Application Priority Data

Aug. 24, 1973 United Kingdom ..... 40154/73

[52] U.S. Cl. ..... 292/319; 292/318; 292/307 R

[51] Int. Cl.[2] ..... B65D 27/30

[58] Field of Search ..... 292/319, 318, 323, 307 R

[56] References Cited

UNITED STATES PATENTS

| | | | |
|---|---|---|---|
| 1,132,970 | 3/1915 | Peyton | 292/307 R |
| 1,333,276 | 3/1920 | Murray | 292/318 |
| 1,577,678 | 3/1926 | Behrman | 292/319 |
| 1,826,033 | 10/1931 | Webster | 292/307 R |
| 1,976,089 | 10/1934 | Peake | 292/318 |
| 2,006,051 | 6/1935 | Keidel | 292/318 |
| 2,144,336 | 1/1939 | Katz | 292/307 R |
| 3,572,795 | 3/1971 | Howard | 292/307 R |
| 3,602,538 | 8/1971 | Canter | 292/318 |

FOREIGN PATENTS OR APPLICATIONS

| | | | |
|---|---|---|---|
| 68,489 | 4/1928 | Sweden | 292/307 R |
| 226,146 | 7/1962 | Austria | 292/307 R |

*Primary Examiner*—Casmir A. Nunberg
*Assistant Examiner*—Victor N. Sakran

[57] ABSTRACT

A disposable padlock which cannot be opened by a key but whose locking effect can only be nullified by the use of sufficient force to deform the padlock. A shackle is automatically engaged when inserted into a body portion of the padlock. Engagement members mounted in the body portion are biassed to engage recesses in limbs of the shackle in such a way that the padlock will deform before the shackle will be removed by the application of force. Means may be provided for preventing rotation of the limbs of a sheared shackle engaged by the body portion.

10 Claims, 15 Drawing Figures

Figure 1:
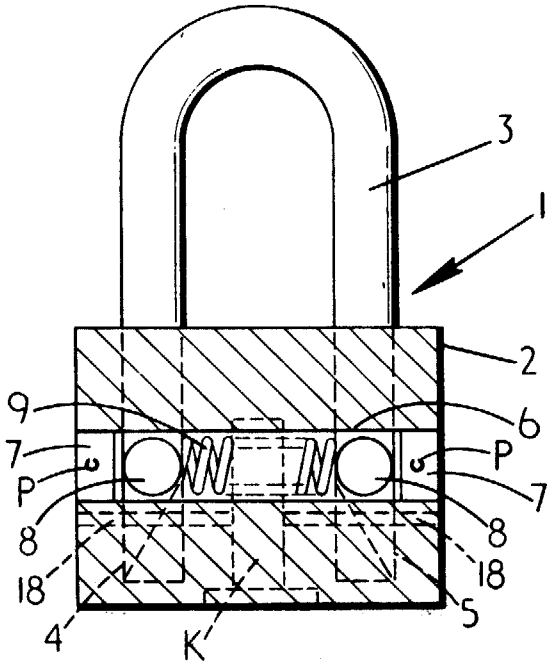

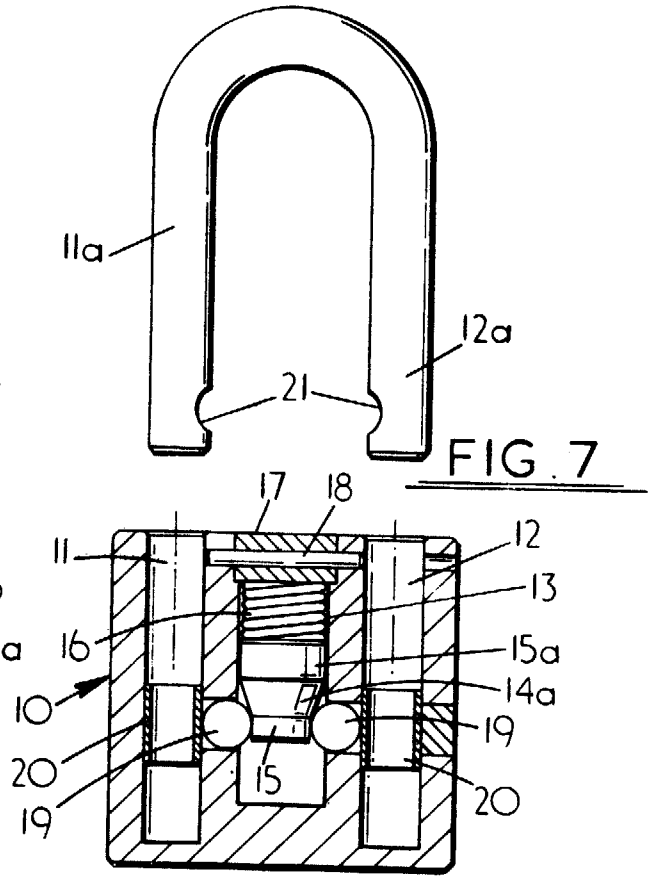
FIG. 7
FIG. 6
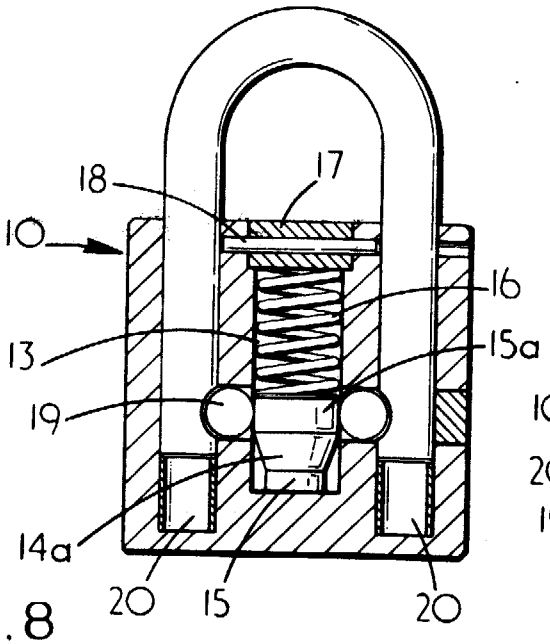
FIG. 8

IMPROVED PADLOCK

This invention has reference to padlocks and has for its object to provide a padlock for use when a high degree of security is required.

Recent trends in the transport of large consignments of goods are towards the use of bulk containers which can be sealed for shipment via road (TIR vehicles), rail, air or sea. One of the problems with the use of such containers has been the difficulty of providing suitable locks for the containers for security during shipment. The difficulties in ensuring that keys for opening such locks cannot be obtained by unauthorised persons have given rise to locks which are expensive and still do not ensure that undetected unauthorised access to the container cannot be effected. This latter point creates problems as between supplier and customer as to discrepancies between the original and final contents of the container.

According to this invention there is provided a keyless disposable padlock comprising a body portion having two substantially parallel bores, a shackle having two limbs capable of insertion into the respective bores of the body portion, and means located within the body portion for automatically engaging said limbs, when they are inserted into said bores, so as to lock the limbs unretractably within the bores whereby the padlock cannot be opened without damaging one or more component parts of the padlock.

Preferably said shackle limbs are provided with recesses and said engaging means includes movable projections biassed to enter said recesses automatically when the limbs are inserted into the limb-receiving bores, the arrangement of the projections and the recesses being such that movement of the limbs along the limb-receiving bores is inhibited.

In a preferred embodiment, the body portion has a cross-bore extending between, and partially intersecting with, the limb-receiving bores, the cross-bore housing two engagement members (for example, balls) biassed apart by means of a spring between them so that said engagement members tend to adopt respective positions in which each engagement member projects partially into one of the associated limb-receiving bores, the limbs of the shackle being such as to push the engagement members together as the shackle is fitted into the body portion, and subsequently to receive the engagement members in recesses in the limbs whereby the limbs are trapped in the body portion.

In another embodiment the body portion has a further, blind bore, a plunger located therein, the plunger having an annular bevelled or tapered face, a cover for said blind bore, a helical compression spring introduced between the cover and plunger, balls fitted in apertures in the body and bearing on the said bevelled or tapered face and sleeves axially slidable in the two limb receiving bores, the construction being such that in priming the body portion to secure the limbs of the shackle the sleeves are positioned to retain the balls against the said tapered or bevelled face to hold the plunger in the position wherein the spring is under compression and when the limbs of the shackle are introduced into the bores the sleeves are displaced to clear the balls whereupon the plunger forces the balls into engagement with the recesses in the limbs of the shackle and thereafter prevents their retraction from the body portion so that the shackle is thus locked in the body portion. A still further feature of this embodiment consists in retaining the cover in the padlock body by means of a pin, introduced through aligned holes in the cover and in the body portion, the withdrawal of the pin being obstructed by the limbs of the shackle, when inserted in the body portion.

Figure 2A:
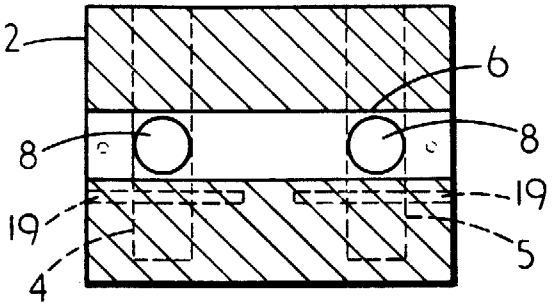
Figure 2C:
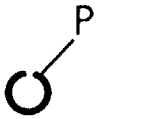
Figure 2B:
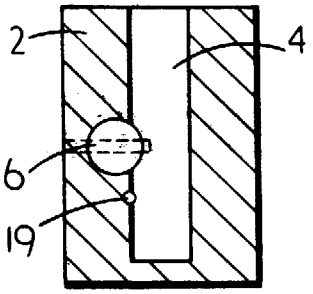
Figures 3A, 3B, 4A, 4B, 4C:
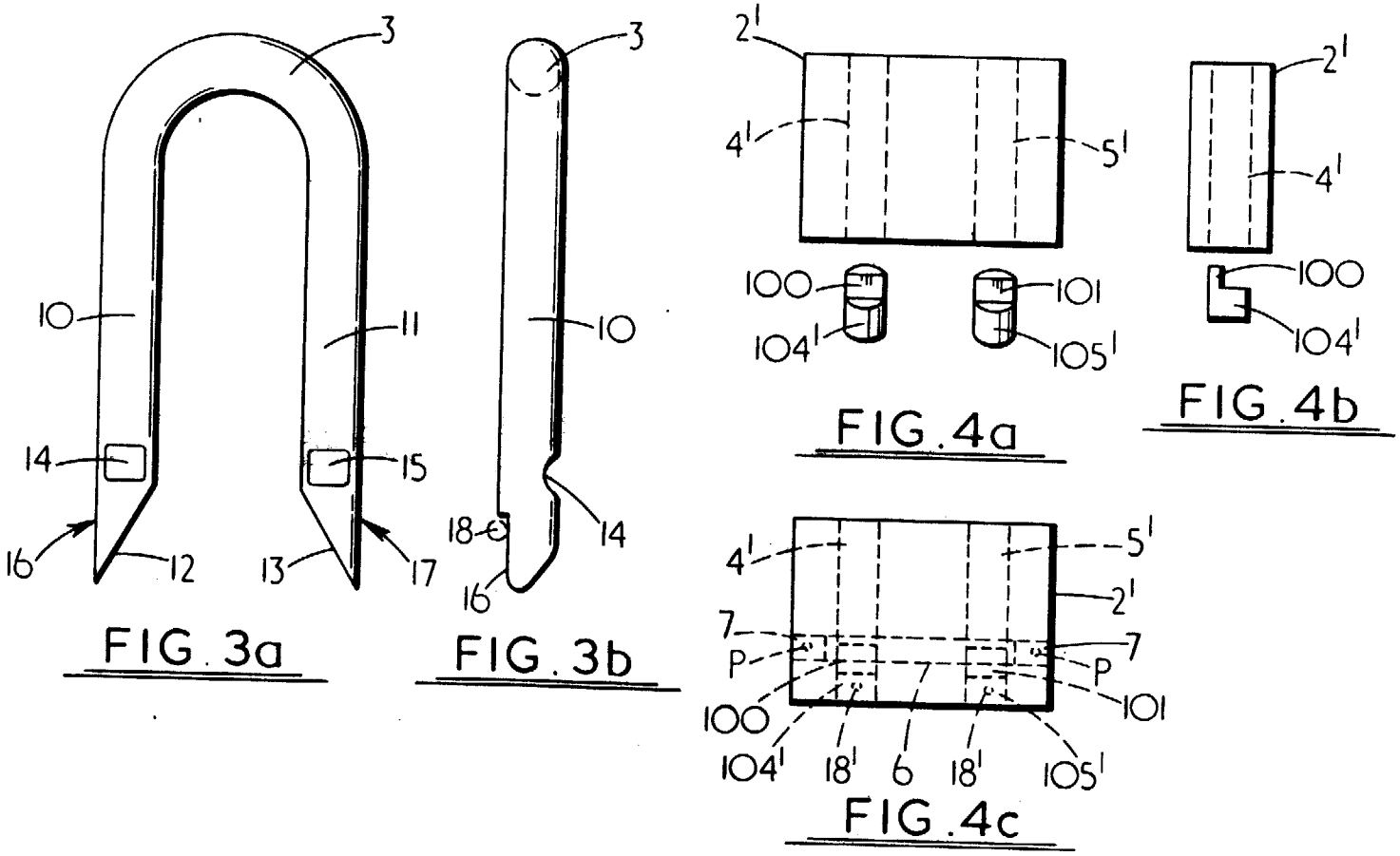
Figures 5A, 5B, 5C:
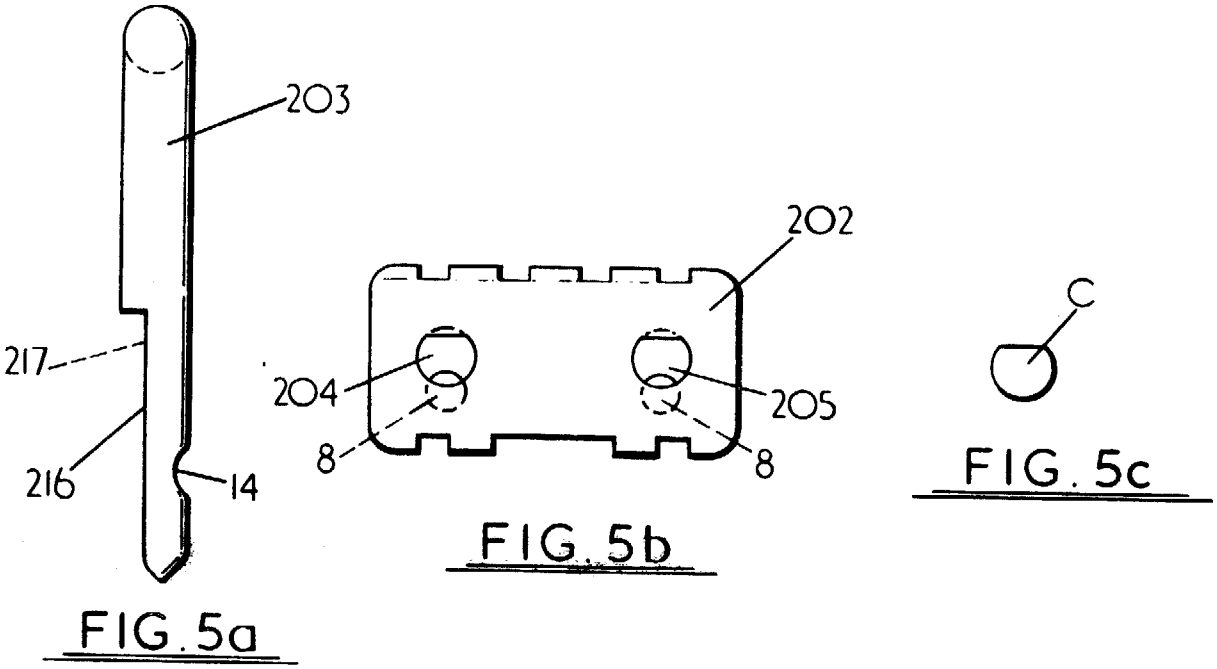

Embodiments of this invention will now be described, by way of examples only, with reference to the accompanying drawings wherein:

FIG. 1 is a sectional view of a first embodiment of padlock according to this invention;

FIGS. 2*a* to 2*c* are front and side sectional views of the body portion of the padlock shown in FIG. 1 and an end view of a securing pin for use with the body portion respectively;

FIGS. 3*a* and 3*b* are respectively front and side elevations of the shackle of the padlock shown in FIG. 1;

FIGS. 4*a* to 4*c* are elevations of a modified form of the body portion shown in FIG. 2, illustrating respective stages in the manufacture of the body portion;

FIGS. 5*a* to 5*c* are respectively a side elevation of a shackle and plan views from underneath of a body portion of a third embodiment of padlock;

FIGS. 6 and 7 are respectively a sectional elevation of a body portion and a front elevation of a shackle of a fourth embodiment of padlock; and FIG. 8 is a sectional elevation of the body portion and shackle shown in FIGS. 6 and 7 and fitted together to form a locked padlock.

Referring to FIGS. 1 to 3*b*, a first embodiment of disposable padlock comprises a body portion 2 into which is fitted a shackle 3.

The body portion 2 is a rectangular-sided block having two limb-receiving bores 4, 5 and a cross-bore 6 extending between, and partially intersecting with, the bores 4 and 5. The ends of the cross-bore 6 are sealed by means of covers 7 held in the body portion by means of hardened steel pins P of split circular cross-section (FIG. 2*c*). The covers 7 hold, within the cross-bore, two engagement members in the form of balls 8 biassed apart by means of a coil spring 9. The length of the sealed cross-bore is such that with the balls 8 at their furthest apart positions they project partially into the bores 4 and 5. If required, a dummy key-hole K may be provided but is preferably omitted.

The shackle 3 is generally U-shaped with two limbs 10, 11 respectively having bevelled tips 12, 13, recesses 14, 15 and flats 16, 17.

Thus when the shackle is pushed into the body portion, the bevelled tips 12, 13 enable the balls 8 to be pushed together to compress the spring 9. When the recesses 14, 15 are level with the cross-bore 6 the balls 8 move into, to engage, the recesses, so that the limbs of the shackle are trapped in the bores 4 and 5, the forces exerted on the balls 8 by trying to pull the shackle out of the body portion having substantially no components tending to force the balls together.

There is a danger that, when the shackle is cut, the construction of the ball-and-recess locking arrangement allows the shackle limbs to be separately rotated to press the balls 8 back into the bore 6 so that the limbs can be removed from the body portion and a new shackle substituted. While this may be an advantage from the point of view of economy (since the body portion can be re-used) it is a disadvantage from the poinot of view that it facilitates unauthorised removal of the padlock once the shackle has been sheared in one place and, more importantly, it allows a substitute shackle to be fitted to the body portion. This last point is of importance since it is desirable that, if a padlock has been interfered with, it should be readily apparent. Although the shackle can be marked for identification, it is easier to mark the body portion so that it is preferred for the shackle limbs to be permanently locked in the body portion whereby substitution of the shackle alone is prevented. Substitution of the padlock can then be rendered apparent by suitably marking the body portion.

To prevent rotation of the separated shackle limbs in the limb receiving bores two hardened steel blocking pins 18 of split circular cross-section are inserted in aligned, separate bores 19 and across the bores 4 and 5 as shown in broken lines in FIGS. 1 and 2 so as to engage the flats 16, 17 and block rotation of the shackle limbs when the balls 8 engage the recesses 14, 15. Each of the bores 19 is open to one face only of the body portion so that the pins cannot be tapped out and their hardening and shape prevent drilling out.

Since the purpose of the pins 18 is effectively to prevent the body portion being re-used, only one of the pins 18 may be provided since a substitute shackle could not be used if one of the limb-receiving bores were blocked.

It is to be noted that if the shackle is inserted back to front into the body portion the pins 18 limit such insertion to the extent that, at the limit, the action of the balls 8 will be to reject the shackle from the body portion due to the taper of the shackle limb ends. Therefore, the shackle cannot be retained in the body portion when back to front unless restraining means such as tape is used. Thus although the application of such restraint enables the provision of a convenient package of the shackle and body portion, it is made difficult to insert the shackle into the body portion in such a way that the padlock appears to be locked when it is not locked.

Clearly other means may be provided instead of the pins 18 as, for example, in the modified body portion 2' shown in FIGS. 4*a* to 4*c* described below.

Referring to FIGS. 4*a* to 4*c* the metal body portion 2' is formed as an extrusion with the limb-receiving bores 4', 5' formed as part of the extrusion process. The cross-bore 6 is then formed by drilling through the body portion from one side to the other. The bores 4' and 5' are then reamed to obtain a suitably clean and polished finish. Thus far, the body portion 2' could be used as the body portion 2 described above merely by sealing one pair of adjacent ends of the limb-receiving bores by means of cylindrical plugs.

As a further modification cylindrical plugs 104', 105' having extensions 100, 101 of D-shaped cross-section are then sweated in place at the ends of the bores 4' and 5' and hardened steel pins 18' of split-circular cross-section are inserted to secure the plugs 104', 105' in place (FIG. 4*c*). The other parts of the padlock are the same as for the embodiment shown in FIGS. 1 to 3.

Thus, when the shackle 3 is inserted into the body portion to be engaged by the balls 8 the flat portions of the extensions 100, 101 lie adjacent the flats 16, 17 respectively to block rotation of the shackle limbs in the bores 4', 5'. Clearly, this modified form of padlock provides advantages over that shown in FIGS. 1 to 3 as regards manufacturing costs.

Referring to FIGS. 5*a* to 5*c*, there is shown a further modified form of the padlock in which the body portion 202 is formed as an extrusion as for the body portion 2' shown in FIGS. 4*a* to 4*c* except in that the limb-receiving bores 204, 205 are now of generally D-shaped cross-section. Also the shackle 203 has flats 216, 217 which extend over the portions of the shackle limbs that engage the bores 204, 205, so that these shackle limb portions are complementally shaped in cross-section with respect to the bores 204, 205. Thus the shackle limbs are inherently non-rotatable within the bores 204, 205 so that there is no need to provide separate means such as the plugs 104', 105' or the pins 18. Thus if it is desired to close one end of each limb-receiving bore then a small plastics cap C is sufficient although a more substantial cylindrical plug may be provided. It is to be noted that the limb receiving bores 204, 205 can be left open at both ends, if desired.

Referring to FIGS. 6 to 8 yet another embodiment of disposable padlock is formed by a block 10 which is of rectangular-sided formation but may be of any other suitable formation. The body has two parallel limb-receiving bores 11 and 12 closed at their lower ends and between said bores is a central bore 13 of larger diameter likewise closed at its lower end. Within the central bore is a plunger which has a downwardly and inwardly bevelled or tapered face 14*a* and below and above its bevelled face are cylindrical faces 15 and 15*a* respectively.

This plunger is downwardly biassed by a helical compression spring 16 introduced between the plunger and a top cover 17 which closes the central bore. The cover is retained in position by means of a pin 18 inserted through aligned holes in the block and cover. It will be noted that the ends of the pin do not project into the bores 11 and 12.

Between the central and the two limb-receiving bores are circular apertures in which are inserted steel balls 19 and inserted in the bores and axially slidable therein are two sheet sleeves 20.

The shackle is of U formation, its two limbs 11*a* and 12*a* being parallel and being such that they can be introduced into the bores 11 and 12. Further the said limbs have opposed recesses 21 which receive the balls as shown in FIG. 8.

It is necessary that the block together with the components be primed to receive the shackle and to do this the sleeves 20 must be so positioned that they hold the balls within their apertures. The plunger is then biased by compressing the spring and holding the spring under compression. This is done by depressing the cover 17 and inserting the pin through the aligned holes in the cover and in the block. That is, the block may then be said to be primed.

In using the padlock the shackle is fitted to engage the parts to be padlocked together and its two limbs introduced into the bores 11 and 12. The introduction of the limbs of the shackle pushes the sleeves 20 clear of the balls and thereafter the spring biased plunger pushes the balls into the recesses in the two limbs. The shackle cannot be withdrawn because the balls now bear on cylindrical part 15*a* of the plunger above the bevel thereof and the cover cannot be detached because it is held in place by the pin and the withdrawal of the pin is obstructed by the limbs of the shackle.

With all the padlocks described above, the body portion is preferably finished in such a way as to conceal the location of the covers 7, plugs 104', 105', cover 17 and any other closures required to seal apertures formed during manufacture.

In each embodiment the method of detaching the padlock is to destroy it by cutting the shackle and, by forming the shackle of a suitable hard metal, the unauthorised cutting thereof can be made a difficult and time consuming operation. Further the shackle would be difficult to detach since it would have to be disengaged from the parts locked together by the padlock. Certainly, once damaged by the cutting of the shackle, the original padlock could not be made to appear as it it had not been interfered with, making detection of such interference more likely.

The padlocks described above are to be so dimensioned, and made of such materials, that the locking effect of the padlock can only be nullified by damaging the padlock, preferably most readily done by shearing of the shackle.

In particular, the padlock shown in FIGS. 1 to 3 can be made so as to inhibit the effects of externally applied magnetic forces on the engagement members (balls 8 in FIG. 1). To counteract such magnetic forces, the shackle can be made of ferromagnetic material and/or the engagement members can be made of non-ferromagnetic material. In addition the spring between the engagement members can be made strong enough to resist practically available magnetic forces acting on the engagement members and/or the body portion 2 can be made of a magnetic shielding material.

During tests of the padlocks described above it has been found that pulling forces upwards of 10,200 lbs force have been required to destroy a padlock made of selected materials and having hardened steel shackles and that the shackle ruptures rather than its limbs being removed from the limb-receiving bores of the body portion. The latter effect is achieved by making the recess-engaging balls of high quality steel more resistant to shearing than the material of which the rest of the padlock is made and also by designing the padlock so as to minimise the force components tending to push the balls out of the recesses in the shackle when trying to pull the shackle from the body portion. Said forces components are zero or negative so that the balls cannot be pushed from the recesses merely by pulling on the shackle.

What is claimed is:

1. A keyless disposable padlock comprising a body portion having two substantially parallel bores, a shackle having two limbs capable of insertion into the respective bores of the body portion, a cross-bore in the body portion partially intersecting with at least one of the bores and having its cross-section eccentric relative to the bore which it intersects, engaging means in the cross-bore, means biassing the engaging means to a position in the partial intersection of the cross-bore and at least one of said bores, at least one limb of the shackle for insertion into at least one intersected bore havingn a portion arranged to be engaged by the engaging means automatically when the limb is inserted into the bore so that the engaging means lies trapped in said partial intersection between the engaged limb of the shackle and the opposite wall of the cross-bore, the engagement by the engaging means preventing movement of at least one limb along at least one of said bores whereby the padlock cannot be opened without damaging at least one of the component parts of the padlock.

2. A padlock according to claim 1 wherein the cross-bore partially intersects with, and is eccentric relative to, both of said bores, and both limbs of the shackle have portions defining recesses arranged to be engaged automatically on insertion of the limbs into the bores by engagement members of the engaging means.

3. A padlock according to claim 2 wherein the shackle ruptures when subjected to a force that tends to remove the shackle from the body portion and that is of lesser magnitude than the force required to overcome the resistance to movement of the limbs of the shackle along said bores due to said engagement by the engaging means.

4. A padlock according to claim 2 wherein said biassing means provides resilient bias and said shackle limbs have respective tapered end portions such that when the limbs are inserted into said limb-receiving bores said tapered portions engage said engagement members to produce force components acting on the engagement members causing the latter to move against said resilient bias until they clear the limb-receiving bores sufficiently to allow complete insertion of the shackle limbs so that said engagement members can then return to their associated intersections to engage the shackle limbs.

5. A padlock according to claim 2 wherein means are provided for preventing rotation of the shackle limbs in the limb-receiving bores when the shackle is sheared to separate said limbs.

6. A padlock according to claim 5 wherein said rotation preventing means includes blocking means extending into at least one of the limb-receiving bores and flats formed on the shackle limbs so that said flats engage said blocking means to prevent rotation of the shackle limbs when the shackle is locked in the body portion.

7. A padlock according to claim 6 wherein said blocking means comprise at least one hardened steel pin fixedly mounted in an associated blind bore parallel and spaced from said cross-bore.

8. A padlock according to claim 6 wherein said body portion and said limb-receiving bores are formed simultaneously by extrusion said limb-receiving bores each having a non-circular cross-section which complementally fits the portion of the associated shackle limb that is provided with said flat.

9. A padlock according to claim 6 wherein said body portion and said limb-receiving bores are formed simultaneously by extrusion, means being provided for sealing the open ends of the limb-receiving bores at one of the sides of the body portion, said sealing means includes a pair of plugs having portions for engaging the flats of the shackle limbs to prevent rotation of the latter when they are inserted into the ends of the limb-receiving bores opposite the sealed ends.

10. A padlock according to claim 4 wherein said biassing means provides resilient bias and said shackle limbs have respective tapered end portions such that when the limbs are inserted into said limb-receiving bores said tapered portions engage said engagement members to produce force components acting on the engagement members causing the latter to move against said resilient bias until they clear the limb-receiving bores sufficiently to allow complete insertion of the shackle limbs so that said engagement members can then return to their associated intersections to engage the shackle limbs, and blocking means, extending into at least one of the limb-receiving bores and arranged to be engaged by at least one of the shackle limbs in such a way that rotation of the latter is inhibited, prevent said shackle being fully inserted back-to-front into said body portion, the engagement members and shackle being such that said back-to-front shackle is not subject to any retaining force exerted by the engagement members.

* * * * *